US006779303B2

(12) United States Patent
Park et al.

(10) Patent No.: US 6,779,303 B2
(45) Date of Patent: Aug. 24, 2004

(54) VEHICULAR POWER WINDOW SAFETY DEVICE

(75) Inventors: Sang-Ryeol Park, Kyungki-Do (KR); Sun-Won Kang, Seoul (KR); Won-Suk Chun, Seoul (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 10/253,845

(22) Filed: Sep. 24, 2002

(65) Prior Publication Data

US 2003/0074840 A1 Apr. 24, 2003

(30) Foreign Application Priority Data

Sep. 29, 2001 (KR) ..... 2001-60942

(51) Int. Cl.[7] ..... E05F 15/02
(52) U.S. Cl. ..... 49/28
(58) Field of Search ..... 49/26, 27, 28, 49/440, 441, 495.1

(56) References Cited

U.S. PATENT DOCUMENTS 5,621,290 A * 4/1997 Heller et al. ..... 49/26
6,138,414 A * 10/2000 Ohmori et al. ..... 49/441
6,281,455 B1 * 8/2001 Plottnik et al. ..... 49/26
6,373,005 B1 * 4/2002 Griesbach et al. ..... 49/28
6,389,752 B1 * 5/2002 Rosenau ..... 49/28

FOREIGN PATENT DOCUMENTS

DE 3424581 * 1/1986 ..... 49/26

* cited by examiner

*Primary Examiner*—Jerry Redman
(74) *Attorney, Agent, or Firm*—Morgan Lewis & Bockius LLP

(57) ABSTRACT

A vehicular power window safety device by which the state of a foreign object being stuck is recognized only when the foreign object makes contact with a weather strip mounted on the upper portion of a door frame, deforming the weather strip, and preventing an excessive contact between the window glass and run channel from being misjudged as an object being jammed therebetween and thereby enabling to obtain an operational trustworthiness on the power window safety device. The device comprises a motor for generating the driving power for lifting and lowering a window glass; a weather strip mounted on an upper area of a door frame and inherently provided with a sensor of which electric resistance is changed by pressure provided by a foreign object stuck in between the weather strip and the window glass due to the lifting of the window glass; and a controller for controlling the motor in response to signals supplied from the sensor.

16 Claims, 2 Drawing Sheets

VEHICULAR POWER WINDOW SAFETY DEVICE

FIELD OF THE INVENTION

The present invention relates to a vehicular power window safety device, and more particularly, to a vehicular power window safety device adapted to prevent erroneous operation.

BACKGROUND OF THE INVENTION

A conventional vehicle is typically provided with a power window regulator for lifting a window glass supported by a door frame motor. There can be a problem, however, in lifting the window glass because injury may occur to occupants, or objects may be damaged by the driving force of the motor when the window glass is raised. This may happen, for example, when a child's hand or an object is accidentally placed in the upper area of the window adjacent the door frame.

In order to reduce accidents involving the operation of power windows, many countries have enacted regulations and allow sales of vehicles only as long as the vehicles meet the requirements of the concerned regulations. A typical prior art safety device for a power window regulator is designed to reverse the direction of the motor when the window glass encounters an obstruction within a safety space at the top of the window (sometimes referred to as an object occupation space). A sensor, such as a hall sensor, is configured to sense the revolutions of the power window motor. When the window glass encounters an obstruction in the safety space, such as a child's hand or other object placed through the window, the force of the object resulting from being pressed against the top of the door frame causes the rotation of the motor to slow down. The sensor detects this slow down and immediately causes the motor to reverse its direction.

However, in normal operation of the window, when the window glass is either ascending or descending, conditions may exist that cause increased friction along the window glass running channels. If this occurs, the motion of the window glass may slow down and the sensor erroneously interprets the slow down as an obstruction in the safety space, causing the window motor to improperly reverse directions.

There is therefore a need in the art for a power window safety device that properly senses unsafe obstructions, but is not erroneously actuated by other, non-safety related operational conditions.

SUMMARY OF THE INVENTION

The present invention provides a vehicular power window safety device adapted to recognize an object as being stuck only when the object makes contact with a weather strip mounted at the upper portion of the door frame to cause the weather strip to become deformed, thereby preventing erroneous operation of the window glass.

In accordance with an embodiment of the present invention, a motor generates the driving force for lifting and lowering a window glass. A weather strip is mounted at the upper portion of the door frame and includes a sensor in which the electric resistance is changed by pressure exerted by an object stuck between the weather strip and the window glass due to the lifting of the window glass. A controller controls the motor in response to signals supplied from the sensor.

In an alternative embodiment, a safety device is provided for a vehicular power window including a window glass in a door frame raised and lowered by a motor, wherein the window glass follows a path defined by channels. In the safety device of this alternative, a deformable weather strip is mounted along an upper region of the door frame in a location to be contacted by the raised window glass. A sensor disposed in the weather strip is configured to generate a signal in response to excessive pressure applied by an object caught between the door frame and window glass. In a preferred embodiment, the signal is a change in resistance. A motor controller communicating with the sensor stops operation of the motor in response to the signals from the sensor. Preferably, the controller is programmed to also reverse operation of the motor in response to the sensor signals.

In a further preferred embodiment, the sensor comprises an elongate member in which electrical resistance changes in response to applied pressure. Thus, the sensor signal preferably represents changed resistance. The weather strip is also preferably configured and dimensioned such that the sensor is disposed interiorly from the window glass path. In such an embodiment the weather strip further defines a sealing member extending towards and intersecting the window glass path, whereby a tight seal is provided with the weather strip when the window glass is fully raised without obstruction. Preferably, the sealing member is provided with a low friction material along a surface adapted to contact the window glass.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Hereinafter, the preferred embodiments of the present invention will be described in detail with reference to the accompanying drawings.

Figure 1:
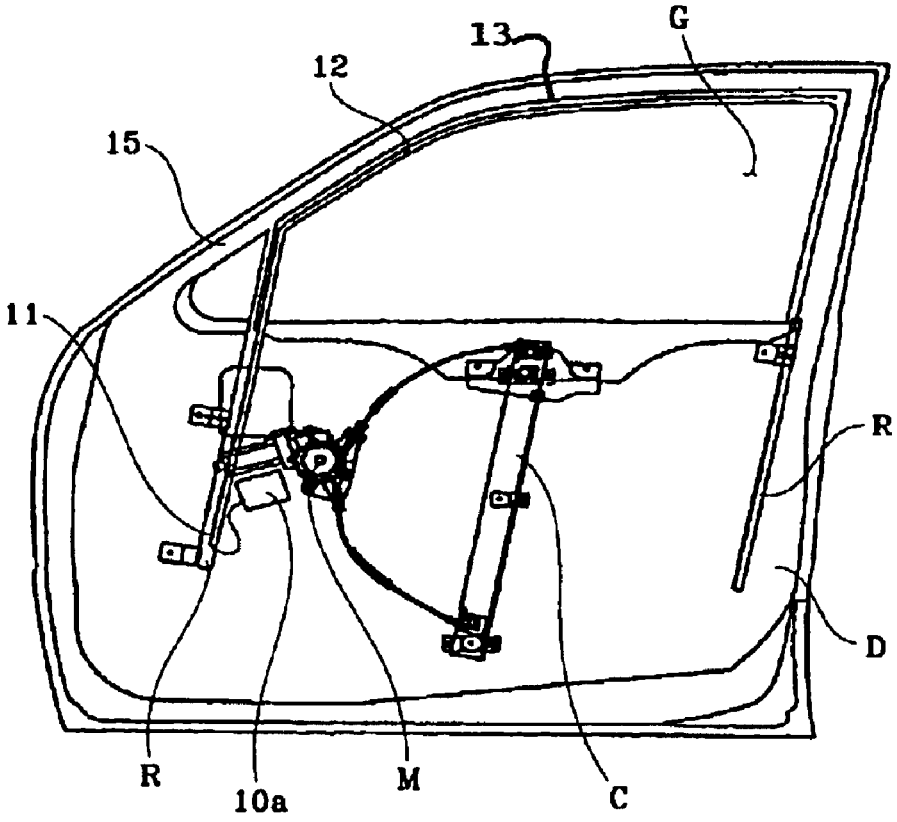
FIG. 1 is a schematic view of a contact-detecting type power window safety device according to an embodiment of the present invention.

As shown in FIG. 1, a power window safety device according to an embodiment of the present invention comprises a motor (M) for generating a driving force for lifting and lowering a window glass (G), a weather strip 13 mounted on a door frame 15 and a controller 10*a* for controlling the motor (M). Controller 10*a* may be a simple programmable logic device or a more complex processor as may be selected and programmed by a person of ordinary skill in the art based on the disclosure herein.

The weather strip 13 includes a sensor 12 in which the electric resistance is changed by pressure resulting from an object interposed between the weather strip 13 and the window glass (G) when the window glass (G) is lifted. As illustrated in detail in FIG. 2, an insert hole 13*a* for inserting the sensor 12 along the upper longitudinal direction of the window glass (G) is formed at a location away from the lifting route of the window glass (G). The insert hole 13*a* is formed at a predetermined, inclined angle (a) relative to a line perpendicular to the lifting and lowering route of the window glass (G) such that even though an object may be obliquely interposed between the window glass (G) and the weather strip 13, pressure applied from the object (B) can be easily detected by the sensor 12.

The sensor 12 is formed in a long strip so as to be inserted lengthwise along the insert hole 13*a* such that even though a part of the strip is locally pressured, the electric resistance of the sensor 12 is changed. Sensor 12 is preferably a material, such as a piezoresistive material, in which the resistance changes in response to applied pressure. Controller 10*a* continually monitors resistance in sensor 12 and initiates control functions as described herein in response to monitored resistance changes. A line 11 from sensor 12 provides communication with the controller 10*a* as illustrated in FIG. 1.

Preferably, the insert hole 13*a* is formed at one side with a triangularly shaped support protruder 13*b*, for spot-supporting the sensor 12. A triangularly shaped plural pressure protruder 13*c* is also formed for evenly applying pressure to the sensor 12. In a superficial area of insert hole 13*a* a protruding contact boss 13*e* is formed for facilitating detection of the object (B) pressed by the lifting window glass (G). Sensitivity can be fully obtained relative to the pressure provided from the object interposed between the weather strip 13 and the window glass (G) as a result of boss 13*e*.

In a further preferred embodiment, the weather strip 13 is provided with a contact end 13*d* that acts as a sealing member abutted to a lateral surface of the window glass (G). Contact end 13*d* changes shape in response to the lifting of the window glass (G), permitting the weather strip 13 to tightly close off the interior by sealing against the window. Preferably, contact end 13*d* includes a sliding membrane 14 of a low abrasive material in order to reduce frictional resistance against the window glass (G). Thus, frictional force generated from the contact end 13*d* and the window glass (G) under the normal operation of the window glass (G) is such that the sensor 12 does not register an erroneous recognition. Preferably, the sliding membrane 14 may be made of a thin rubber material coated with polypropylene or urethane.

Figure 2:
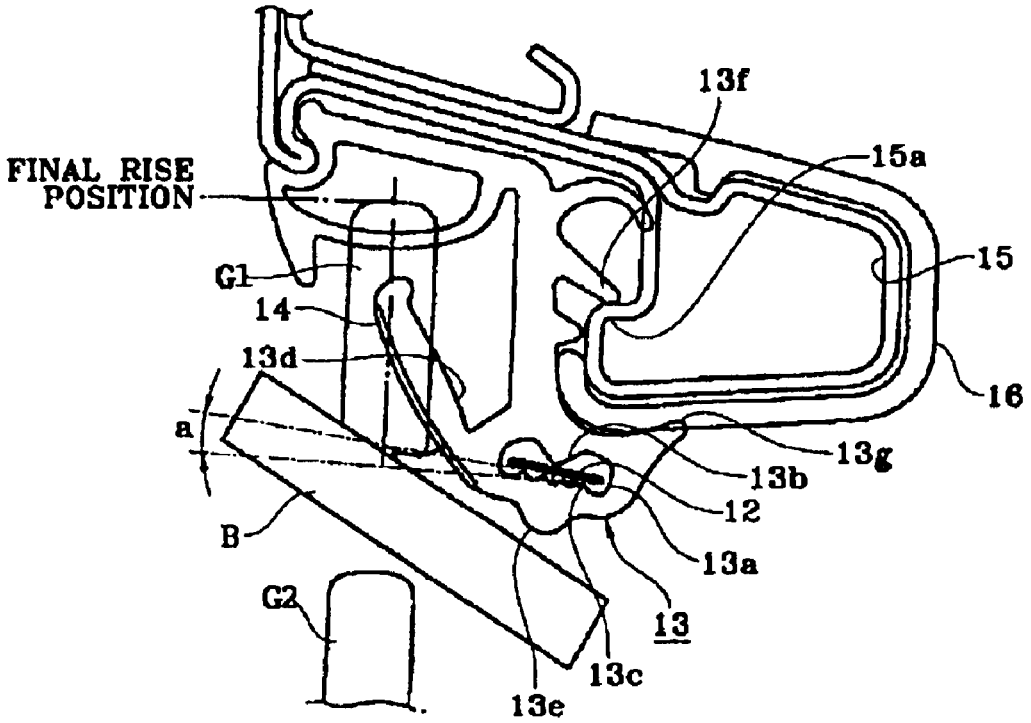
FIG. 2 is a cross-sectional view illustrating a contact detection unit as shown in FIG. 1.

In preferred embodiments weather strip 13 is also provided with an upper marginal portion 13*g*, which protrudes toward the door frame 15 to be deformed and closely adhere to the door frame 15 when the weather strip 13 is coupled to the frame. In this manner, the portion of the weather strip with insert hole 13*a* into which the sensor 12 is inserted can be prevented from becoming loose, so that the sensor 12 may operate properly. As shown in FIG. 2, The door frame 15 is covered by a cover member 16. In an embodiment thus illustrated, where the cover member 16 is employed, the upper marginal portion 13*g* of the weather strip may be formed in a protrusive shape toward the cover member 16.

The door frame 15 preferably includes a hitching jaw 15*a* protruding toward a lateral surface of the weather strip 13. The weather strip 13 is formed along its lateral surface with a hitching lip 13*f*. The hitching lip 13*f* is hitched at the hitching jaw 15*a* to prevent the weather strip from drooping down, thereby obtaining a proper and stable operation of the sensor 12.

Hereinafter, the operation of the present invention thus constructed will be described. First, an operational status where no object (B) obstructs the normal operation of a window glass (G1) is described with reference to FIG. 2.

When the window glass (G1) is lifted by the driving force provided by the motor (M) and is completely raised, the contact end 13*d* of weather strip 13 is changed in shape as shown. Contact end 13*d* is abutted to a lateral surface of the window glass (G1) by way of an inherent resilience thereof, thereby enabling it to perform a fundamental function of the weather strip for maintaining an air-tight sealing. The sliding membrane 14 formed at the contact end 13*d* minimizes the frictional force generated by the window glass (G1) while the window glass (G1) is lifted. The sensor 12 thus does not erroneously identify the frictional force generated between the window glass (G1) and the contact end 13*d* as an object interposed between the window glass (G1) and the weather strip 13.

Next, a scenario will be described where a human body or other object (B) is stuck between the upper end of the window glass (G2) and the weather strip 13 while the window glass (G2) is lifted. Referring again to FIG. 2, when the window glass (G) is lifted by the driving force of the motor (M), an interposed foreign object (B) causes the upper end of the window glass (G2) to apply pressure against the weather strip 13. The pressure applied to the foreign object (B) is then transmitted to the sensor 12 within the insert hole 13*a* through the contact boss 13*e*.

The pressure is precisely transmitted to the sensor 12 by the pressure protruders 13*c* and the support protruder 13*b*. Thus, the sensor 12 changes in electrical resistance, which is then detected by the controller 10*a*. When the electrical resistance of the sensor 12 exceeds a predetermined value, the controller 10*a* determines that an object (B) is caught in between the window glass (G2) and the weather strip 13. In this condition the controller 10*a* stops and reverses the direction of the motor (M).

In the vehicular power window safety device thus described according to the present invention, the controller is able to differentiate a case where friction is caused by the excessive contact in the run channel (R) and a case where the foreign object (B) is caught in the upper region of the door frame 15, thereby eliminating erroneous operation. As apparent from the foregoing, there is an advantage in the vehicular power window safety device thus described according to the present invention in that the state of an object being stuck is recognized only when the object contacts and applies pressure against a weather strip mounted on the upper portion of a door frame, deforming the weather strip.

The foregoing descriptions of specific embodiments of the present invention are presented for purposes of illustration and description. They are not intended to be exhaustive or to limit the invention to the precise forms disclosed. Obviously many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

What is claimed is:

1. A vehicular power window safety device, comprising:

a motor for lifting and lowering a window glass;

a weather strip mounted on an upper region of a door frame, including a sensor in which electric resistance is changed by pressure applied by an object stuck in between the weather strip and the window glass due to the lifting of the window glass; and a controller for controlling the motor in response to changed resistance in the sensor, wherein an insert hole is defined in said weather strip along an upper lengthwise direction of said window glass, said hole being formed at a location away from a lifting route of said window glass for inserting said sensor, and wherein a contact end is formed on a superficial area of said insert hole thereof with a protruding contact boss for detecting the object pressed by the lifting of said window glass.

2. The device as defined in claim 1, wherein the insert hole is formed at one side thereof with a triangularly shaped support protruder for spot-supporting said sensor and is formed at the other side thereof with triangularly shaped plural pressure protruders for evenly applying the pressure to said sensor.

3. The device as defined in claim 1, wherein said insert hole slants at a predetermined angle relative to a line perpendicular to the lifting route of said window glass.

4. The device as defined in claim 1, wherein said contact end changes shape upon contact with said window glass.

5. The device as defined in claim 4, wherein the contact end is provided with a sliding membrane of low abrasive material in order to reduce the frictional resistance against said window glass when said contact end contacts said window glass.

6. The device as defined in claim 4, wherein the sliding membrane is made of a thin rubber material coated with polypropylene.

7. The device as defined in claim 4, wherein said sliding membrane is made of a thin rubber material coated with urethane.

8. The device as defined in claim 1, wherein said weather strip is provided with an upper marginal portion that protrudes toward said door frame in order to be deformed and closely adhere to said door frame when said weather strip is coupled to said door frame.

9. The device as defined in claim 1, wherein said door frame is provided with a hitching jaw protruding toward a lateral surface of said weather strip, and said weather strip is formed at a lateral surface thereof with a hitching lip so that the hitching lip is hitched at the hitching jaw to prevent said weather strip from drooping down.

10. A safety device for a vehicular power window including a window glass in a door frame raised and lowered by a motor, the safety device comprising:

a deformable weather strip mounted along an upper region of the door frame in a location to be contacted by the raised window glass;

a sensor disposed in said weather strip, said sensor configured to generate a signal in response to excessive pressure applied by an object caught between the door frame and window glass; and a motor controller communicating with the sensor to stop operation of the motor in response to signals from the sensor;

wherein the window glass follows a path defined by channels and said weather strip is configured and dimensioned such that the sensor is disposed interiorly from the window glass path and presents a protruding contact boss along an outer face thereof.

11. The safety device of claim 10, wherein the controller is programmed to reverse operation of the motor in response to said sensor signals.

12. The safety device of claim 10, wherein the sensor comprises an elongate member in which electrical resistance changes in response to applied pressure.

13. The safety device of claim 12, wherein said signal represents changed resistance.

14. The safety device of claim 13, wherein said controller monitors the resistance of the sensor.

15. The safety device of claim 10, wherein said weather strip further defines a sealing member extending towards and intersecting the window glass path whereby a tight seal is provided with the weather strip when the window glass is fully raised without obstruction.

16. The safety device of claim 15, wherein said sealing member is provided with a low friction material along a surface adapted to contact the window glass.

* * * * *